US005542673A

United States Patent [19]

Lammertink

[11] Patent Number: 5,542,673

[45] Date of Patent: Aug. 6, 1996

[54] INTERSECTING MANIPULABLE PUZZLE

[75] Inventor: Ferdinand Lammertink, Hengelo, Netherlands

[73] Assignee: Binary Arts Corporation, Alexandria, Va.

[21] Appl. No.: 366,878

[22] Filed: Dec. 30, 1994

[51] Int. Cl.[6] ..... A63F 9/08

[52] U.S. Cl. ..... 273/153 S; 273/281

[58] Field of Search ..... 273/153 S, 153 R, 273/155, 281

[56] References Cited

U.S. PATENT DOCUMENTS

| | | | |
|---|---|---|---|
| 1,206,054 | 11/1916 | Trull . | |
| 3,601,404 | 8/1971 | Weisbecker . | |
| 3,709,497 | 1/1973 | Barlow . | |
| 4,402,510 | 9/1983 | Yokoi . | |
| 4,412,681 | 11/1983 | Irwin | 273/153 S |
| 4,451,040 | 5/1984 | Ashley | 273/153 S |
| 4,468,033 | 8/1984 | Minami et al. | 273/153 S |
| 4,471,959 | 9/1984 | Rubik | 273/153 S |
| 4,480,839 | 11/1984 | Waters, Jr. | 273/153 S |
| 4,482,154 | 11/1984 | Mizunuma et al. . | |
| 4,524,971 | 6/1985 | Sasso | 273/153 S |
| 4,813,679 | 3/1989 | Hoffman . | |
| 4,877,248 | 10/1989 | Farraj et al. . | |
| 5,035,430 | 7/1991 | Suzuki | 273/153 S |
| 5,172,912 | 12/1992 | Lammertink . | |

FOREIGN PATENT DOCUMENTS

| | | | |
|---|---|---|---|
| 2521022 | 8/1983 | France | 273/153 S |
| 2186495 | 8/1987 | United Kingdom | 273/153 S |

*Primary Examiner*—Steven B. Wong

*Attorney, Agent, or Firm*—Beveridge, DeGrandi, Weilacher & Young, LLP

[57] ABSTRACT

A manipulable self-contained game puzzle with a base, multiple slider members mounted on the base through a switch and movable coded transfer members transferably mounted on the slider members for selective movement of the coded transfer members relative to the slider members and the base so as to permit manipulation of the individual coded transfer members into a selected pattern.

22 Claims, 5 Drawing Sheets

INTERSECTING MANIPULABLE PUZZLE

TECHNICAL FIELD

This invention relates to amusement and recreation devices of the solvable puzzle variety. This invention relates, more particularly, to a manipulable puzzle with a plurality of movable pieces independently mounted on and movable relative to multiple intersecting slider members which, in turn, are slidably mounted on a channeled base. Each slider member is able to movably secure and support a select number of the movable pieces. At least three slider members are required where the first slider member is disposed in a first direction and the second and third slider are disposed to translate in directions that transect the first slider member and each of the second and third slider members engage a mechanical switch which is secured on the base in a manner to pivot relative thereto. When the movable members are coded, the puzzle is solvable by sequential displacement of coded movable members carried by the intersecting translating slider members. Sliding the slider members causes selected coded movable members to move relative to each other and the base which rearranges the movable members into a select pattern relative to the base.

BACKGROUND OF THE INVENTION

Manipulable puzzles are very popular for diversion, recreation, and amusement. In recent years, such puzzles have become increasingly challenging, spurred by the popularity and development of manipulable puzzles such as the linearly oriented SpinOut®, the rotation puzzle Backspin®, and the early manipulable puzzle, Rubik's Cube®. The advantages of such devices is that they are self-contained, challenging, and permit discontinuous activity without disrupting progress toward the puzzle's solution. Furthermore, such puzzles promote analytical thinking since they require the user to predict the result of each particular manipulation. Being intelligent, not always recreational, yields a result that satisfies. Therefore, manipulable puzzles can enhance self-confidence.

SUMMARY OF THE INVENTION

It is an object of the present invention to provide the advantages of an novel, manipulable puzzle for amusement and entertainment.

It is another object of this invention to provide a manipulable puzzle capable of different solutions ranging from a low to a high degree of difficulty.

Another object of this invention is to provide a puzzle which is at once attractive and challenging.

Still a further object of this invention is to provide a unitary, self-contained puzzle.

It is still another object of this invention to provide a self-contained, manipulable puzzle which provides amusement, recreation, and interruptable use in a novel and attractive form.

A further object of this invention is to provide a novel puzzle with a novel method of play.

These and other objects of the invention are satisfied by a manipulable puzzle, comprising:

a base with first, second and third channels, said first channel extending in a first direction and said second and third channels being parallel, spaced apart and disposed to intersect said first channel;

a rocker switch having two engaging ends pivotally mounted with respect to said base;

a first slider member associated with said first channel and adapted to translate in said first direction;

second and third slider members respectively translatably secured within said second and third channels, said second and third members being respectively disposed at each engaging end of said rocker switch so that translation in a selected direction of one of said second or third slider members in said second or third channels respectively causes the other of said slider members to translate in its respective channel in the opposite direction; and a plurality of independently movable pieces interlockingly mounted with respect to said first, second and third slider members where selected translation of said slider members causes selected ones of said movable pieces to move relative to each other and the slider members.

Still other objects of this invention are satisfied by a method of manipulating a puzzle with a plurality of independently movable, interlocking pieces mounted on a base with at least a first, second, and third sliders, the second and third sliders being disposed in a direction which intersects the direction of the first slider and the second and third sliders being interconnected to slide equidistantly in opposed directions. The puzzle is manipulated by selecting a desired pattern of said movable pieces; and translating at least the first and second sliders to cause a selected movable piece to move relative to the base and the sliders.

The invention requires a base and individual, independently interconnected moveable pieces associated with at least three slider members. Two of the slider members are directly linked through a switch secured to the base between which permits coordinated movement of the two members and the moveable pieces thereon independent of the third slider member. The pieces, base, and slider members are all coupled in a manner to define a closed loop of a fixed area in which the pieces are moved. Thus, this invention permits movement of the pieces in a constrained area regardless of the particular sequence of linear movement of each piece.

The puzzle may be constructed using movable pieces/buttons coded exclusively by color and/or may incorporate three dimensional tactile indicia. Use of three-dimensional indicia in the puzzles of this invention expand the problem solving and eye-hand coordination enhancing capacity of the puzzle the applicability of color-only embodiments by providing a tactile based embodiments. Such tactile based embodiments minimize the importance of the visual component but substitute touch for vision while preserving the problem solving character of the puzzle. Thus, the inventive puzzle herein is readily adapted for use by the visually challenged to provide a substantially similar quality of analytical head-hand movement where the user is required to predict the result of each particular manipulation.

This invention also contemplates a method of producing and assembling the inventive puzzle.

Given the following enabling description of the drawings, the inventive, manipulable puzzle should become evident to a person of ordinary skill in the art.

BEST MODE FOR CARRYING OUT THE INVENTION

Figure 1:
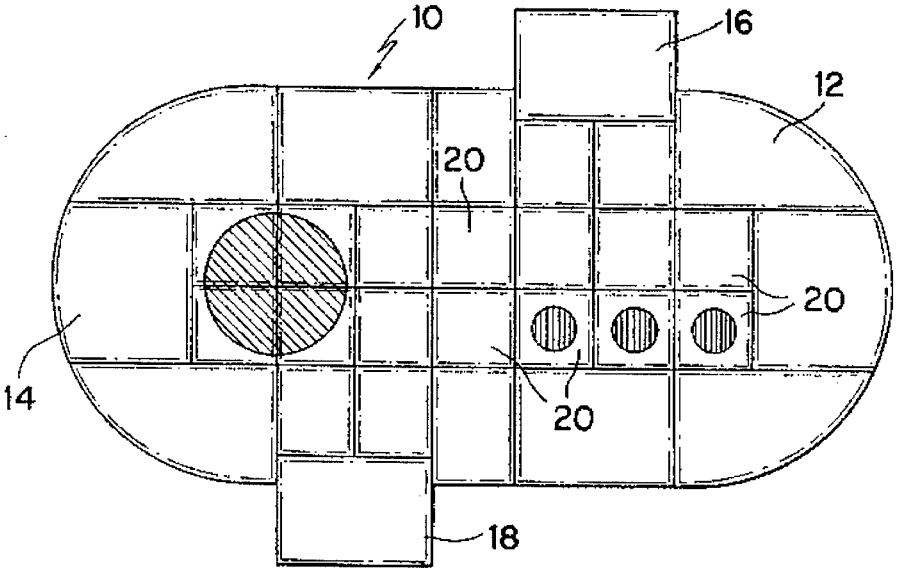
FIG. 1 is a top view of the illustrated embodiment of the inventive puzzle.
Figure 2:
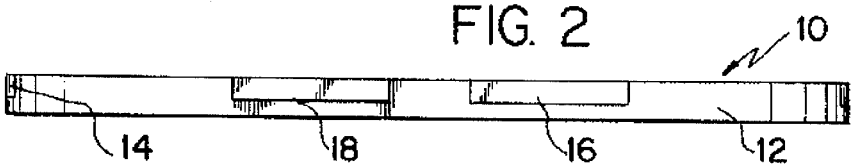
FIG. 2 is a longitudinal side view of the puzzle depicted in FIG. 1.
Figure 3:
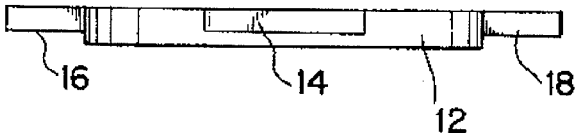
FIG. 3 is a lateral side view of the puzzle depicted in FIG. 1.

The illustrated manipulable puzzle of the invention is generally designated by the number 10. The illustrated puzzle 10 comprises a base 12 and provides for manipulation on the upper surface of the base 12. The base 12 is oblong and formed from a rugged molded thermoplastic material such as high impact styrene copolymers. In the illustrated embodiment, all of the components are formed of the same molded, rugged polymer resin as the base 12.

The base 12 includes-three channels formed on its upper surface which accommodate slider members 14, 16, and 18. The elongated slider member 14 formed from the same thermoplastic material as the base 12 and extends in the direction of elongation of the oblong base 12. For reference purposes herein, slider members 16 and 18 which intersect the channel containing elongated slider member 14 are referred to as lateral slider members. First lateral slider member 16 and second lateral slider member 18 extend across the upper surface of base 12 and are transversely disposed to the elongated slider member 14. In the illustrated embodiment the lateral slider members 16 and 18 are parallel to each other. The details of the construction of the respective slider members 14, 16 and 18 are detailed below.

The active portion of the puzzle 10 is a plurality (as illustrated, eighteen) of square, movable pieces 20. The movable pieces 20 are interlockingly seated on the base 12 and the slider members 14, 16, and 18. The interlocking pieces 20 are independently movable and may be colored or tactually coded with three dimensional features. The inventive puzzle 10, according to the illustrated embodiment, is self-contained and forms a unitary structure.

Figure 4:
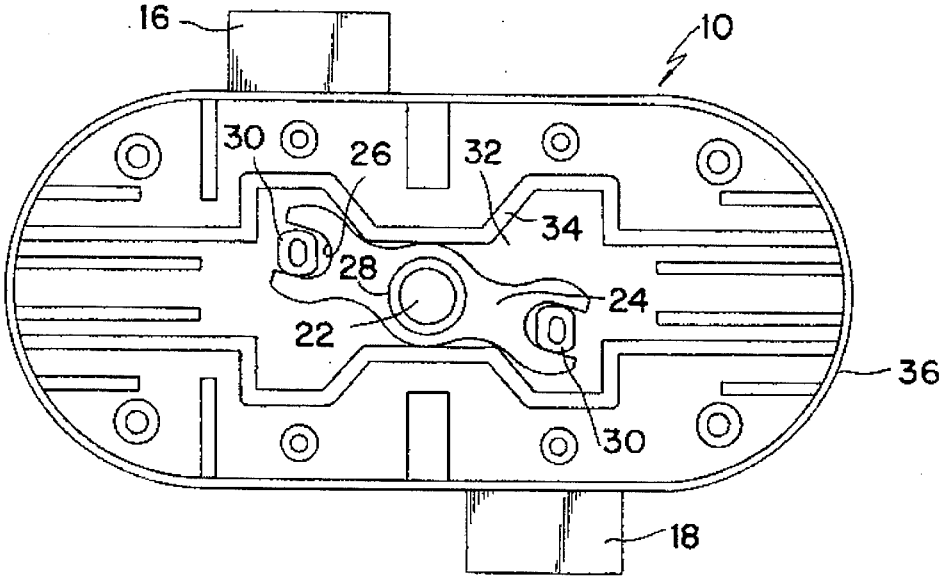
FIG. 4 is a cut away bottom view of the puzzle depicted in FIG. 1.
Figure 5:
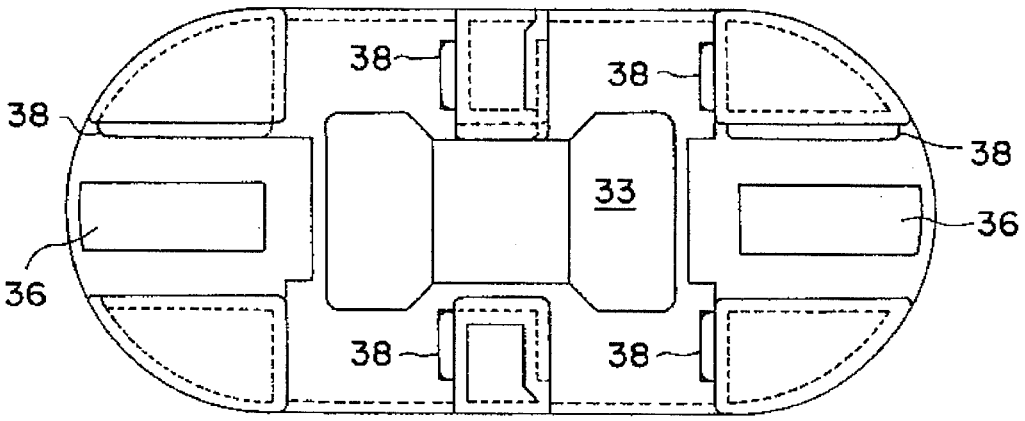
FIG. 5 is a top view of the upper base section of the puzzle depicted in FIG. 1.
Figure 6:
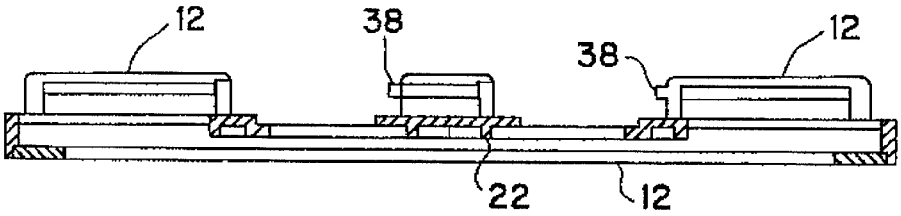
FIG. 6 is a cut-away view of the base along the elongated bisector of the puzzle depicted in FIG. 1.
Figure 7:
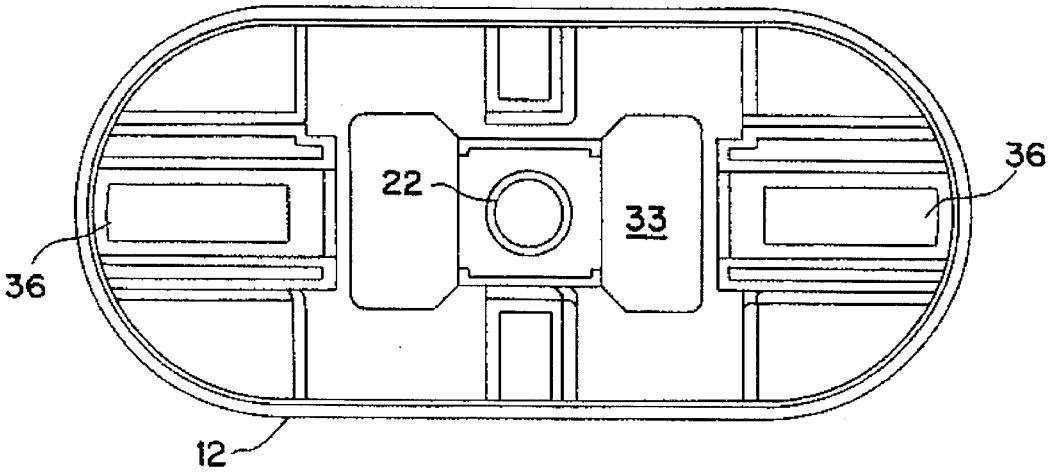
FIG. 7 is a cut-away bottom view of the base in FIG. 4.

The base 12 includes certain structural features illustrated in FIGS. 3, 4, 5, 7, and 12 the purpose of which become clear in the functional explanation below. Referring to FIG. 4, the bottom of the base 12, as illustrated, includes a centrally disposed and depending annular lug 22. The annular lug 22 has an outer diameter of a specific dimension. The base 12 includes elongated slider apertures 36 located proximate to the ends of the first elongated channel (see FIG. 5). Those elongated apertures 36 have a length substantially equal to the length of two of the movable pieces 20. Interior of the elongated openings 36 and underlying the parallel channels for the lateral sliders 16 and 18, the base 12 also features a pair of openings 33 which are adapted to receive the downwardly projecting lugs 30 from those slider members.

Throughout the drawings, a number of laterally projecting members/lugs 38 are depicted. Those lugs 38 correspond to complementary facing grooves formed on the side walls respectively of the base 12 and the slider members 14, 16, and 18. The lugs 38 and corresponding grooves provide the interlocking of the puzzle components necessary to achieve a unitary puzzle structure. The lugs 38 are dimensioned to provide a little frictional resistance in the complementary grooves but also to limit that resistance so that the slider members and the movable pieces 20 can translate easily with respect to the base 12.

Referring again to the annular lug 22 of the base 12, its outer diameter correspond to the inner diameter of the central opening 28 in the wrench-shaped yoke switch 24. Thus, the yoke switch 24 can be pivotally mounted on the lug 22 so as to pivot relative to the base 12. The yoke switch 24 is elongated and also features oppositely facing C-shaped end sections 26, each defining a U-shaped opening.

As clearly depicted in FIGS. 5–8 and 12, the openings in the yoke end sections 26 are dimensioned to receive and cooperate with irregular, oblong-shaped yoke engaging lugs 30 depending from slider members 16 and 18 through openings 33 in the base 12. The yoke switch 24, being pivotally mounted on lug 22 and engaging the slider yoke depending lugs 30, serves to restrict the movement of the lateral sliders relative to the base 12 by limiting the translation of the sliders 16 and 18 to the tangent of the pivot arc of the switch 24. Furthermore, due to the interconnection with the other lateral slider, translational movement of one lateral slider relative to the base, causes the yoke switch 24 to pivot and to translate the other slider equidistantly in the opposite direction.

The degree of pivoting movement of the yoke switch 24 relative to the bottom of the base 12 is constrained by the border walls 34 defining an hour glass shaped pivot chamber 32. The pivot chamber walls 34 limit the arc of rotation permitted the yoke switch 24 to, preferably, substantially two lengths of one moveable piece 20.

Figure 8:
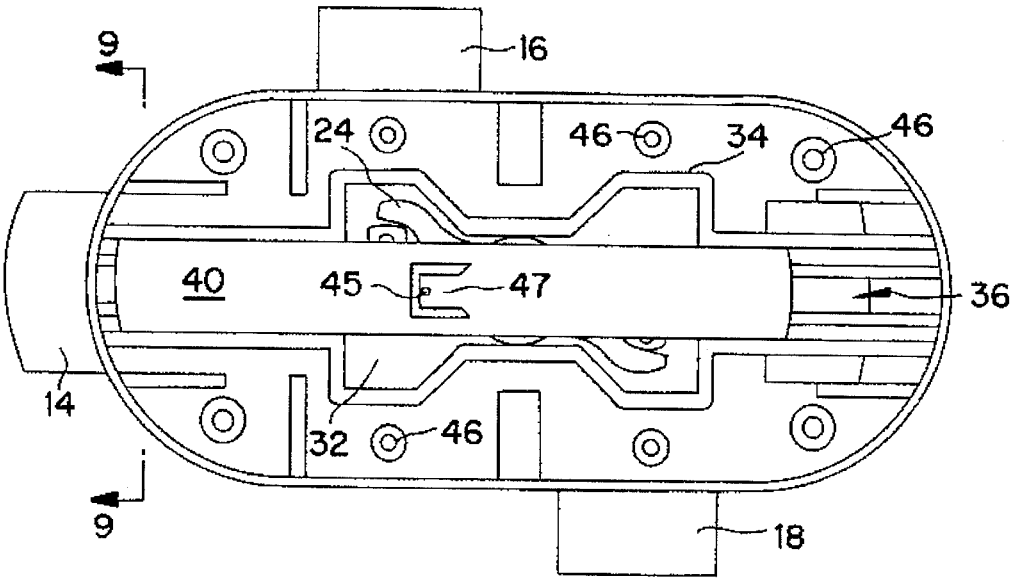
FIG. 8 is a cut away bottom view of the longitudinal slider member assembled in the puzzle depicted in FIG. 1 and FIG. 4.
Figure 9:
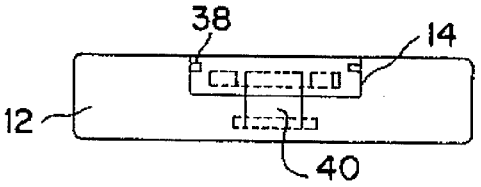
FIG. 9 is a side view of the longitudinal slider member of the puzzle depicted in FIG. 1.
Figure 10:
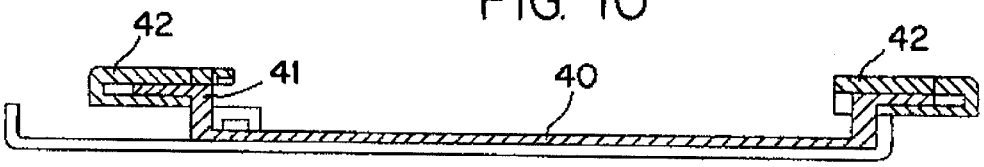
FIG. 10 is a cut-away side view of the longitudinal slider member mounted in the puzzle along the bisector as depicted in FIG. 6.
Figure 11:
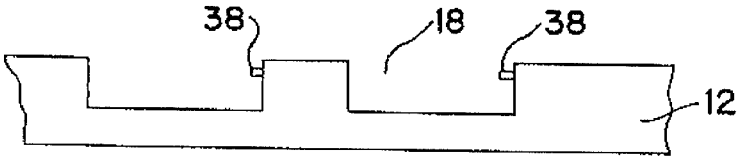
FIG. 11 is a side view of the lateral slider members mounted in the base of the puzzle depicted in FIG. 1.
Figure 12:
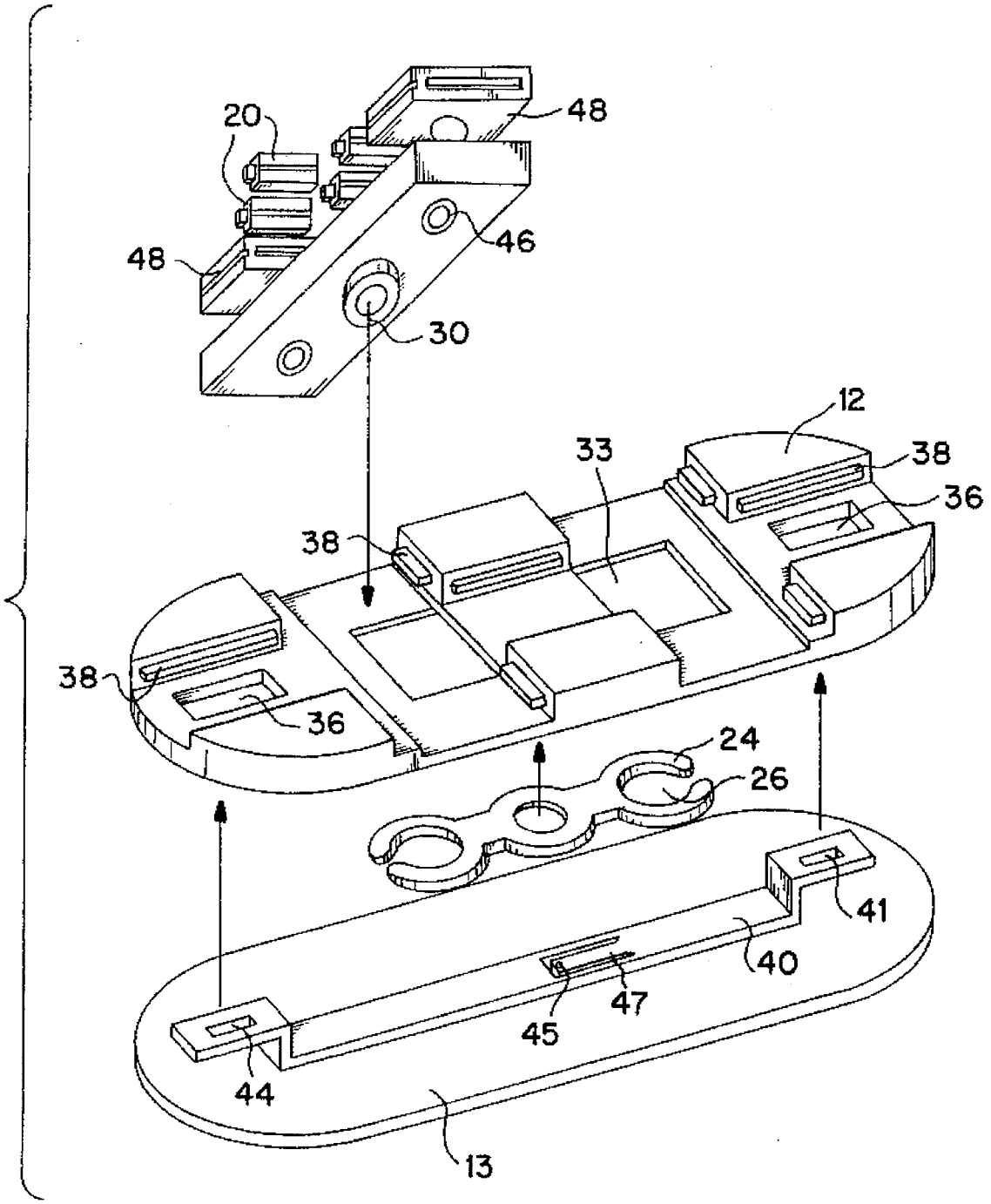
FIG. 12 is an exploded, assembly view of the slider members, base, rocker switch as mounted in the base of the puzzle depicted in FIG. 1.
Figure 13:
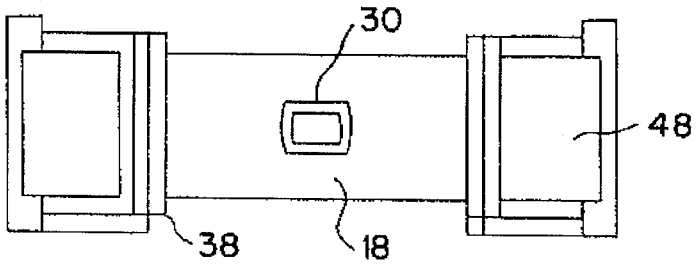
FIG. 13 is a bottom view of a lateral slider member of the puzzle depicted in FIG. 1.
Figure 14:
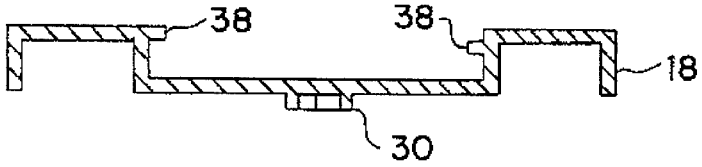
FIG. 14 is a side view of the lateral slider member of FIG. 13 of the puzzle depicted in FIG. 1.

Referring specifically to FIGS. 8, 10, and 12, the multi-piece construction of the slider elements is detailed. The elongated slider member 14 is comprised of an elongated slider rail 40 featuring tanged end portions 41 and a central detent prong 45 mounted at the end of a flexible finger tine 47. Each of the upper portions of tanged end portions 41 include a hole 44 adapted for receiving and securing end caps 42. The end cap 42 width corresponds to the width of the elongated channel in the base 12. The vertical portion of the tang 41 has a width corresponding to that of the elongated aperture 36 in the base 12 so that the depending vertical portion of tang 41 projects downwardly through the elongated aperture 36. By this structure, the elongated portion of the longitudinal slider rail 40 is disposed between the base 12 and the base bottom plate 13, captures the yoke switch 24, and underlies the first transverse slider member 16 and second transverse slider member 18. Thus, the elongated slider may translate independently of the lateral sliders 16 and 18 for a total distance of two lengths of the moveable pieces 20.

Of the slider 14 assembly, only the end caps 42 directly contact the movable members 20. The combination of the elongated rail 40, the tangs 41, and the end caps 42 actually push the movable pieces along the upper surface of the longitudinal channel of the base 12. Because the end caps 42 are the only structure of the elongated slider member 14 which contact the movable pieces 20, the end caps 42 also feature lugs 38 and corresponding grooves for interlocking the movable pieces 20 with respect to the base 12.

The particular assembly technique used for the construction of the end caps 42 is not critical to the invention. Typical adhesives may be substitute for or may supplement the illustrated friction/force fit multi-piece construction. The illustrated construction of the end caps 42 with the longitudinal slider 40 is representative of such a force-fit assembly of the thermoplastic components comprising the puzzle 10. For example, referring to FIGS. 8 and 12 a compression, post/hole, force fit assembly of the lateral end cap 48 is depicted.

Figure 15:
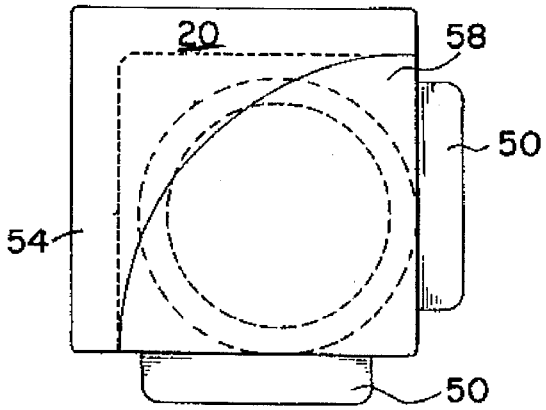
FIG. 15 is a detailed top view of a movable indicia bearing piece including underlying features represented by ghost lines of the puzzle depicted in FIG. 1.
Figure 16:
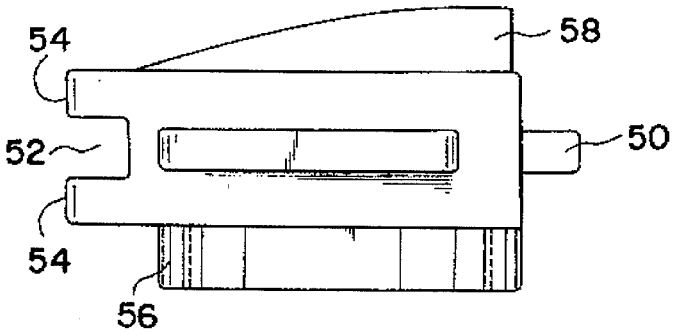
FIG. 16 is a detailed side view of the movable piece including a three-dimensional/tactile indicia designating portion according to FIG. 15.

The individual moveable pieces are illustrated in FIGS. 15 and 16. Each of the moveable pieces include lands 50 and kerfs 52 defined by kerfs walls 54. The interrelationship of the lands and kerfs of the moveable pieces 20 provide for interlocking of those pieces with respect to each other, the base 12 and the slider members 14, 16, and 18. Projecting from the bottom of each moveable piece as spacer 56 which dimensioned to assure necessary spacing to achieve projection interlocking. Finally, with respect to the structures depicted in FIGS. 15 and 16, the figures depict a three dimensional indicia element 58 which would be incorporated in different configurations for different moveable pieces and may be combined with different colors as desired by puzzle designer.

In operation, the puzzle 10, provides a unitary assembly of components and which provides a puzzle defining a closed loop for movement of the individual puzzle pieces. The puzzle 10 has eighteen movable pieces 20. At all times, fourteen of the eighteen pieces are associated with the elongated slider 14 and six of the movable pieces 20 are associated with each of lateral sliders 16 and 18. The puzzle pieces 20 are displaced in a closed loop by first sliding elongated slider member 14 in one direction a distance sufficient to displace the eighteen pieces the length of one or two movable pieces 20. As mentioned the illustrated embodiment includes a detent prong 45 mounted at the end of a flexible finger tine 47 integral with slider rail 40. The prong 45 is biased to ride over a shallow groove or nib positioned on the upper surface of the lower base plate 13. The groove or nib is located to correspond to the midpoint of travel permitted using the horizontal slider member 16, i.e., one length of movable members 20. While the horizontal slider may move a total of two lengths, the detenting action permits tactile sensing (by clicking) when the prong 45 rides over the groove or nib which indicates a shift of one length by the movable members. If shifted either one or two lengths the movable pieces will be properly aligned with lateral sliders 16 and 18 to permit lateral movement.

After the movement by the elongated slider, the lateral slider members 16 and 18 can move the moveable pieces by one piece length. Due to the linking yoke switch 24, movement of one of the lateral sliders causes both to move. Thus, the twelve movable pieces 20, associated with the lateral sliders 16 and 18 are displaced by one length; six in one direction and six in the opposite direction. Sequential reciprocation of the sliders causes the individual movable pieces to be rearranged within the closed loop provided by the base 12. Thus, the puzzle may be solved by sequential manipulation and rearranging the pieces 20 into a desired pattern.

A person of ordinary skill can appreciate that the invention is not limited to the embodiment described above. Possible variations and modifications to the invention include, for example, varying the specific dimensions of the base and of the respective structural features. Those dimensions are governed by the specific puzzle construct and need not be of particular significance so long as they adhere to the functional principals described above. Other potential variations include the increasing the number of coded movable members and/or the number of channels and corresponding slider members, appreciating that the degree of difficulty increases exponentially with such additions. Subject to preserving the transecting relationship between one slider member with two other slider members, the particular geometry and arrangement of the base, the slider members, etc. can be modified without departing from the scope of this invention. For example, the slider members and or movable members may possess three dimensional features and/or unique color coding and the switch yoke may include an articulated linkage for interconnecting slider members extending in different planes.

In matters of production, the components may be assembled using adhesives, welding, or other conventional attachment techniques to substitute for the illustrated cooperating friction fit components.

Industrial Applicability

The invention herein provides a manipulable puzzle which is self contained, attractive, and challenging. The puzzle provides a unique method of play by sequential displacement within a closed path of individual indicia bearing pieces to achieve a desired pattern thereof. The puzzle is capable of providing entertainment to a broad range of persons, including even the visually challenged. The puzzle is useful as a means to promote analytical thinking and as an amusement and entertainment device.

Given the foregoing, variations and modifications to the invention should now be apparent to a person having ordinary skill in the art. These variations and modifications are intended to fall within the scope and spirit of the invention as defined by the following claims.

What is claimed is:

1. A manipulable puzzle, comprising:

a base with first, second and third channels, said first channel extending in a first direction and said second and third channels being parallel, spaced apart and disposed essentially orthogonally to said first channel;

a rocker switch having two engaging ends pivotally mounted with respect to said base;

a first slider member associated with said first channel and adapted to translate in said first direction;

second and third slider members respectively translatably secured within said second and third channels, said second and third members being respectively disposed at each engaging end of said rocker switch so that translation in a selected direction of one of said second or third slider members in said second or third channels respectively causes the other of said second or third slider members to translate in its respective channel in the opposite direction; and a plurality of independently movable pieces interlockingly mounted on said first, second and third slider members where selected translation of said slider members causes selected ones of said movable pieces to move relative to each other and the slider members.

2. A manipulable puzzle according to claim 1 where the base is oblong, said first channel and slider member are elongated and correspond to the elongated axis of the oblong base, and the second and third slider members are generally orthogonal to the first slider member.

3. A manipulable puzzle according to claim 2 where the independently movable pieces are square and indicia bearing.

4. A manipulable puzzle according to claim 3 where the second and third slider members are greater in length than the second and third channels respectively by the length of one side of the movable pieces.

5. A manipulable puzzle according to claim 4 where said base includes two elongated apertures formed proximate to each end of the elongated first channel, the first slider member includes bent tanged members at each end which are received by and translate within said elongated apertures and where the first slider member underlies said rocker switch in said base.

6. A manipulable puzzle according to claim 5 further comprising end cap pieces formed on each end of each slider member.

7. A manipulable puzzle according to claim 6 where there are eighteen movable pieces mounted on said slider members, where the first slider member has fourteen movable pieces associated with it at any given time and the second and third sliders have six movable pieces associated with each at any given time.

8. A manipulable puzzle comprising:

a base with upper and lower surfaces, a peripheral edge and at least three channels, two of said at least three channels being generally parallel to one another and which intersect the third of said at least three channels, said channels being defined in the upper surface of the base and including elongated retaining lugs projecting into each channel;

apertures in said peripheral edge corresponding to the ends of each channel;

a plurality of slider members corresponding to the number of channels, each slider member being adapted to be translatably secured within a respective one of said channels and where said slider members adapted to translate within said at least two parallel channels have upper and lower surfaces and centrally disposed lugs depending from their respective lower surfaces;

an elongated yoke switch pivotally secured to said base and including a lug engaging element at each end, said lug engaging element engaging said lugs in a manner where applying translational force to one of said at least two parallel slider members, causes both slider members to translate equidistantly in opposite directions; and a plurality of indicia bearing movable buttons mounted on the upper surfaces of said slider members, said movable buttons including retaining lugs to interlock the buttons together relative to each other and the base.

9. A manipulable puzzle according to claim 8 where said base is oblong, said third channel is elongated, said base includes two elongated apertures formed proximate to each end of the elongated third channel, the slider member for the third channel includes tanged members at each end which are received by and translate within said elongated apertures and where the third slider member underlies said elongated yoke switch in said base.

10. A manipulable puzzle according to claim 8 where there are eighteen movable buttons mounted on said slider members, where the third slider member has fourteen movable buttons associated with it at any given time and the first and second sliders have six movable buttons associated with each at any given time and where said first and second slider members have a length approximately one moveable button longer than the corresponding channel.

11. A manipulable puzzle comprising:

a base with at least a first channel extending in a first direction and second and third channels extending in a second direction substantially orthogonal to said first direction where said second and third channels intersect said first channel;

first second and third slider members corresponding to and associated respectively with said first, second, and third channels;

a linkage switch pivotally secured to the base, connected to and pivotally linking said second and third sliders in a manner to translate said sliders in opposite directions relative to said base upon application of moving force to one of the sliders; and a plurality of independent interlockable movable pieces associated with said first, second, and third sliders and permanently interlocked relative to said base;

where movement of said sliders causes the movable pieces to be rearranged relative to each other and the base.

12. A manipulable puzzle, comprising:

a base containing first, second and third channels;

a rocker switch pivotally mounted on said base;

a first slider member mounted to said base in association with said first channel so as to be capable of limited translation relative to said base;

second and third slider members, mounted in a direction transverse to said first slider and in said second and third channels, said second and third slider members engaging said rocker switch so that upon pivotable rotation of the rocker switch, the second and third slider members translate relative to the second and third channels respectively; and a plurality of interlocking, independently movable pieces bearing selected indicia being positioned in association with said channels and said slider members and secured thereon in a manner to permit independent movement of said movable pieces upon limited movement of said sliders relative to said base.

13. A method of assembly of an amusement device including a base containing multiple intersecting channels, a first translatable slider secured to the base in a first direction, a second and a third slider being mounted on said base and extending in a direction essentially perpendicular to said first direction, a mechanical rocker switch pivotally mounted on the base, a plurality of independent movable members slidably mountable on the sliders, and a capping element comprising the steps of:

a) securing the first, second, and third sliders and the rocker switch relative to the base;

b) causing the second and third sliders to engage the rocker switch in a manner where translation of the second slider causes the switch to pivot relative to the base resulting in the equidistant translation of the third slider relative to the base;

c) positioning the independently movable members in the channels formed in the base and over the slider members in a manner to movably interlock the movable members; and d) movably securing the movable members on the base with the capping element.

14. A method of manipulating a puzzle with a plurality of independently movable, interlocking pieces mounted on a base with first, second, and third sliders, the second and third sliders being disposed in a direction which intersects the direction of the first slider and the second and third sliders being interconnected to move equidistantly in opposed directions, the puzzle manipulation method comprising the steps of:

a) selecting a desired pattern of said movable pieces; and b) translating at least the first and second sliders to cause a selected movable piece to move relative to the base and the sliders.

15. The puzzle manipulation method of claim 14 further comprising the step of translating the second slider to cause equidistant translation of the third slider relative to the base.

16. A puzzle comprising a base, a rocker switch mounted on said base, first, second, and third sliders mounted on said base and interconnected with said rocker switch, and a plurality of independently interlocking pieces mounted on the first, second and third sliders mounted on said base, where movement of said rocker switch causes the second and third sliders to move in opposed directions relative to said base.

17. The puzzle of claim 16 where the second and third sliders move equidistantly in opposed directions.

18. A method of forming a manipulable puzzle comprising assembling the puzzle of claim 1.

19. A method of forming a manipulable puzzle comprising assembling the puzzle of claim 11.

20. An amusement method comprising manipulating the puzzle according to claim 1.

21. An amusement method comprising manipulating the puzzle according to claim 11.

22. An amusement method comprising manipulating the puzzle according to claim 12.

* * * * *